US011179774B2

(12) United States Patent
Collura et al.

(10) Patent No.: US 11,179,774 B2
(45) Date of Patent: Nov. 23, 2021

(54) SELF-LOCKING INNER NOZZLE SYSTEM

(71) Applicant: VESUVIUS GROUP, S.A., Ghlin (BE)

(72) Inventors: Mariano Collura, Strepy-Bracquegnies (BE); Jean-Luc Renard, Saint-Symphorien (BE); Fabrice Sibiet, Colleret (FR)

(73) Assignee: VESUVIUS GROUP, S.A., Ghlin (BE)

( * ) Notice: Subject to any disclaimer, the term of this patent is extended or adjusted under 35 U.S.C. 154(b) by 0 days.

(21) Appl. No.: 16/762,920

(22) PCT Filed: Nov. 9, 2018

(86) PCT No.: PCT/EP2018/080826
§ 371 (c)(1),
(2) Date: May 9, 2020

(87) PCT Pub. No.: WO2019/092212
PCT Pub. Date: May 16, 2019

(65) Prior Publication Data

US 2021/0170479 A1 Jun. 10, 2021

(30) Foreign Application Priority Data

Nov. 10, 2017 (EP) ..... 17200986

(51) Int. Cl.
*B22D 41/50* (2006.01)
*B22D 41/56* (2006.01)

(52) U.S. Cl.
CPC ..... *B22D 41/502* (2013.01); *B22D 41/56* (2013.01)

(58) Field of Classification Search
None
See application file for complete search history.

(56) References Cited

U.S. PATENT DOCUMENTS 4,718,580 A * 1/1988 Bierbaum ..... B22D 41/22 222/598
5,335,896 A 8/1994 Idstein et al.
2020/0360991 A1* 11/2020 Sibiet ..... B22D 41/28

FOREIGN PATENT DOCUMENTS

CN 1424949 A 6/2003
CN 2560456 Y 7/2003
CN 201105322 Y 8/2008
(Continued)

*Primary Examiner* — Scott R Kastler
(74) *Attorney, Agent, or Firm* — Parthiban A. Mathavan

(57) ABSTRACT

A self-locking inner nozzle system locks an inner nozzle in operating position at an outlet of a metallurgic vessel for a time sufficient for a sealing material to set, said self-locking inner nozzle system comprising:

(A) an inner nozzle, provided with N≥2 protrusions, distributed around a perimeter of the lateral surface, (B) an upper frame rigidly fixed to a bottom surface of a metallurgic vessel, (C) a locking ring, rigidly fixed to the upper frame wherein, an inner surface of the locking ring is provided with N L-shaped channels, such that the inner nozzle can be inserted along a longitudinal axis, Z, through an opening of the locking ring, with the N protrusions being engaged in corresponding first channel portion until they abut against corresponding first channel ends, at which point the inner nozzle can be rotated about the longitudinal axis to engage the protrusions along corresponding second channel portions to self-lock the inner nozzle in its operating position.

15 Claims, 6 Drawing Sheets

(56) References Cited

FOREIGN PATENT DOCUMENTS

| | | | |
|---|---|---|---|
| CN | 210231514 | U | 4/2020 |
| EP | 2790856 | A2 | 10/2014 |
| JP | H09201657 | A | 8/1997 |
| KR | 20030054769 | A | 7/2003 |
| WO | 2015124567 | A1 | 8/2015 |

* cited by examiner (a)

(b)

SELF-LOCKING INNER NOZZLE SYSTEM

CROSS-REFERENCE TO RELATED APPLICATIONS

This application is a U.S. national stage application, filed under 35 U.S.C. § 371, of International Application No. PCT/EP2018/080826, which was filed on Nov. 9, 2018, and which claims priority from European Patent Application No. EP17200986.2, which was filed on Nov. 10, 2017, the contents of each of which are incorporated by reference into this specification.

BACKGROUND OF THE INVENTION

(1) Field of the Invention

The present invention relates to metallurgy installations. In particular, it concerns a self-locking inner nozzle able, when mounted in the outlet of a metallurgy vessel to maintain its operative position at least during the time required for a sealing material precursor to set into a stiff seal to seal and secure the inner nozzle in its operative position, without the need of an operator or of a robot to hold it in place as the sealing material precursor is setting.

(2) Description of the of the Related Art

In metal forming processes, molten metal (1) is transferred from one metallurgy vessel (200L, 200T) to another, to a mould (300) or to a tool. For example, as shown in FIG. 1 a ladle (200L) is filled with molten metal out of a furnace (not shown) and transferred through a ladle shroud (111) into a tundish (200T) for casting. The molten metal can then be cast through a pouring nozzle (101) from the tundish to a mould (300) for forming slabs, billets, beams or ingots. Flow of molten metal out of a metallurgy vessel is driven by gravity through a nozzle system (101,111) located at the bottom of said vessel. The flow rate can be controlled by a gate.

In particular, the inner surface of the bottom floor of a ladle (200L) is provided with an inner nozzle (10) comprising an inner bore. The outlet end of said inner nozzle is coupled to a gate, generally a sliding plate gate or a rotating plate gate, controlling the flow rate of molten metal out of the ladle. In such gates, a fixed plate provided with a bore is fixed to an outer surface of the ladle bottom floor with the bore positioned in registry with the inner nozzle's bore. A moving plate, also provided with a bore can move such as to bring the bore in or out of registry with the bore of the fixed plate, thus controlling the flow rate of molten metal out of the ladle. In order to protect the molten metal from oxidation as it flows from the ladle into a tundish (200T), a ladle shroud (111) is brought in fluid communication with the outlet end of the collector nozzle and penetrates deep into the tundish, below the level of molten metal to form a continuous molten metal flowpath shielded from any contact with oxygen between the inlet end of the inner nozzle within the ladle down to the outlet of the ladle shroud immersed in the liquid metal contained in the tundish. A ladle shroud is simply a nozzle comprising a long tubular portion crowned by an upstream coupling portion with a central bore. The ladle shroud is inserted about and sealed to a short collector nozzle (100) coupled to and jutting out of the outer surface of the ladle bottom floor, and which is separated from the inner nozzle (10) by a gate. JPH09201657 describes an example of automatic attachment/detachment of a ladle shroud to/from a collector nozzle coupled to a ladle, by using a rotary bayonet- or screw-engagement means and a robot.

Similarly, an outlet of the bottom floor of a tundish (200T) is also provided with an inner nozzle (10) rather similar to the one described supra with respect to a ladle. The downstream surface of said inner nozzle can be coupled directly to a pouring nozzle (101) or, alternatively, to a tube changing device. In order to protect the molten metal from oxidation as it flows from the tundish to a mould (300), the pouring nozzle (101) penetrates deep into the mould, below the level of molten metal to form a continuous molten metal flowpath shielded from any contact with oxygen between the upstream surface of the inner nozzle within the tundish down to the outlet of the pouring nozzle immersed in the liquid metal flowing into the mould. A pouring nozzle is a nozzle comprising a long tubular portion crowned by an upstream coupling portion with a central bore. A pouring nozzle can be inserted about and sealed to a short collector nozzle (100) coupled to, and jutting out of the outer surface of the tundish bottom floor. For continuous casting operations, flow rate out of a tundish is generally controlled by means of a stopper (7) or the combination of a gate and a stopper. A sliding gate or rotating gate as described above can also be used for the casting of discrete ingots.

In practice, a ladle is prepared for operation including building the refractory inner liner, fixing a gate to the bottom of the ladle, positioning an inner nozzle, refractory plates and a collector nozzle. When ready for operation, the ladle is driven to a furnace where it is filled with a fresh batch of molten metal, with the gate in a closed configuration. It is then brought to its casting position over a tundish (200T), where a ladle shroud is coupled to the collector nozzle in a casting configuration, such that the outlet end of the collector nozzle (100) is snuggly nested in the bore inlet of the ladle shroud to form a sealing joint (cf. FIG. 1B). The ladle shroud can be maintained in its casting configuration by a robot or by any other means known in the art, such as described in WO2015124567. The gate is opened and the molten metal can flow out of the ladle into the tundish through the inner nozzle, gate, collector nozzle, and ladle shroud. When the ladle is empty, the gate is closed and the ladle shroud is retrieved to allow the removal of the empty ladle and replacement by a second ladle filled with a new batch of molten metal. The ladle and the gate refractories are first inspected for defects. Then the ladle is either sent back to the furnace for a refill of molten metal, or is sent for repair, where one or more of the refractory components (e.g., plates, collector nozzle, and inner nozzle) are replaced when required.

After a number of pouring cycles by the ladle, various components of the ladle and of the tundish can be worn off or broken and must be changed. This includes the inner nozzle. At regular intervals or after detecting wear of the refractory components, a ladle is brought apart and restored after a tundish filling operation is completed and prior to driving the ladle back to the furnace. This includes repairing the refractory lining (200*r*) of the ladle, changing the inner nozzle and/or installing a new gate. The tundish cannot be restored as often as a ladle, since a tundish remains filled with molten metal during a complete casting session.

An inner nozzle (10) is generally inserted substantially horizontally into the outlet of a metallurgic vessel (200) which is lying on its side. The inner nozzle is sealed to the outlet with a rather thick layer of a sealing material precursor, generally a wet cement, applied in the gap between the outlet and the inner nozzle, and is secured in its operating position when the sealing material precursor sets to form a stiff seal. As the sealing material is setting, the inner nozzle must be held in position by an operator or by a robot to ensure that it maintains its position. If an operator inserts and holds the inner nozzle in place, it may move out of alignment with the risk of possible leaks during casting. During the whole setting time of the sealing material, an operator or a robot cannot perform any other duty.

U.S. Pat. No. 5,335,896 proposes to use a lock ring segment. The nozzle segment to lock an inner nozzle in place. The lock ring segment includes a fastening means for removably attaching the lock ring segment within the discharge bore of a ladle mounting plate. The inner nozzle and lock ring segment include cooperating tapered surfaces to provide a slip plane for compressing and extruding bonding material from between mortar joints of the two-piece nozzle insert.

The present invention proposes a self-locking inner nozzle allowing the locking in place of the inner nozzle without any operator or robot, at least for the time necessary for the sealing material precursor to set to form a stiff seal and secure the inner nozzle in its operative position. These and other advantages of the present invention are presented more in details in continuation.

SUMMARY OF THE INVENTION

The present invention is defined in the appended independent claims. Preferred embodiments are defined in the dependent claims. In particular, the present invention concerns a self-locking inner nozzle system for locking an inner nozzle in operating position at an outlet of a metallurgic vessel for a time sufficient for a sealing material to set, said self-locking inner nozzle system comprising:

(A) an inner nozzle comprising:

(a) an upstream surface and a downstream surface joined to one another by a lateral surface of nozzle height, h, and comprising a bore extending along a longitudinal axis, Z, from the upstream surface to the downstream surface, (b) N protrusions, with N≥2, distributed around a perimeter of the lateral surface, each protrusion comprising a downstream face and an upstream face separated from one another by a thickness, t, of the protrusion, the protrusions having an azimuthal width, W, measured normal to the longitudinal axis, Z, (B) an upper frame suitable for being rigidly fixed to a bottom surface of a metallurgic vessel, (C) a locking ring, rigidly fixed to the upper frame and extending along the longitudinal axis, Z, from an upstream edge to a downstream edge, and defining an opening defined by an inner surface joining the upstream and downstream edges, wherein, the inner surface of the locking ring is provided with a number N of L-shaped channels, each L-shaped channel having:

(a) a first channel portion extending along the longitudinal axis, Z, from the downstream edge to a first channel end of the first channel portion, and having a width, W1, larger than the width, W, of the protrusions, allowing the translation along the longitudinal axis, Z, of the inner nozzle through the opening of the locking ring with the upstream surface engaged first on the downstream edge side of the locking ring, with the protrusions engaged in corresponding first channel portions until the protrusions abut against the corresponding first channel ends, where the inner nozzle is prevented from translating further along the longitudinal axis, Z, and (b) a second channel portion (33) extending transverse to the longitudinal axis, Z, from the first channel end and having a width, W2, larger than the thickness, t, of the protrusions, allowing engagement of the protrusions into the corresponding second channel portions by the rotation of the inner nozzle about the longitudinal axis, Z, into a locking position, where the inner nozzle is prevented from being pulled out of the locking ring by the protrusions being engaged in the second channel portion.

It is advantageous that N=3 or 4. In all cases it is advantageous that the N protrusions be distributed evenly around a perimeter of the lateral surface. The lateral surface of the inner nozzle preferably comprises rotating grips, including lugs or recesses positioned adjacent to the downstream surface of the inner nozzle, and allowing the insertion of a tool for rotating the inner nozzle about the longitudinal axis, Z, and pulling the inner nozzle out of the locking ring along the longitudinal axis, Z, when the inner nozzle is inserted in the locking ring. The rotating grips can be made of metal and may belong to a metal can cladding at least a portion of the lateral surface of the inner nozzle.

The protrusions are advantageously made of a material which is brittle or ductile, and the protrusions have dimensions such that the protrusions can be flexurally deformed or broken by application of a force, preferably of not more than 400 N, upon removing the inner nozzle from the operating position. For example, the protrusions can be made of metal and can belong to a metal can cladding at least a portion of the lateral surface of the inner nozzle, and/or preferably protrude out of, and belong to a flange surrounding a whole perimeter of the lateral surface, normal to the longitudinal axis, Z.

The protrusions are advantageously located at a distance, d, to the downstream surface measured along the longitudinal axis, Z, of not more than 30%, preferably not more than 20% of the nozzle height, h.

In an advantageous embodiment, the second channel portion comprises a lateral edge on the side of the downstream edge of the locking ring which is at an angle forming a thread, such that the rotation of the inner nozzle towards the locking position translates the inner nozzle deeper through the locking ring.

A self-locking inner nozzle system according to the present invention can be mounted at a bottom surface of a metallurgic vessel selected among a ladle, a furnace, or a tundish. It is advantageously coupled to a mechanism, such as a gate, which is fixed to the bottom surface of the metallurgic vessel.

The present invention also concerns a method for securing an inner nozzle in operating position to an outlet of a metallurgic vessel, said method comprising the following steps:

(a) providing a self-locking inner nozzle system as described above, (b) applying a sealing material precursor into the outlet of the metallurgic vessel and/or onto the lateral surface of the inner nozzle, (c) engaging the inner nozzle with the upstream surface first through the locking ring opening from the downstream edge, and driving the inner nozzle along the longitudinal axis, Z, through the locking ring with the N protrusions engaged in corresponding first channel portions, all the way until the protrusions abut against the first channel ends, (d) rotating the inner nozzle about the longitudinal axis, Z, thus engaging the protrusions into the second channel portions (33) until the inner nozzle is self-locked into its operating position and cannot move along the longitudinal axis, Z, (e) allowing the sealing material precursor to transform into a stiff seal (2) to seal and secure in its operating position the thus self-locked inner nozzle, without holding it in position by any external means.

Steps (c) and/or (d) can easily be carried out by a robot.

The present invention also concerns a method for retrieving from an outlet of a metallurgic vessel an inner nozzle as defined supra, previously secured in its operating position by a method as described above, said method comprising the step of gripping a surface of the inner nozzle with a tool and either, (a) Pulling the inner nozzle along the longitudinal axis, Z, wherein the protrusions are made of a material which is brittle or ductile as described above, with a force sufficient to, on the one hand, disrupt a sealing bond formed between the inner nozzle and the stiff seal and, on the other hand, to break or deform the protrusions to allow the passage of the inner nozzle through the opening of the locking ring, or (b) Rotating about the longitudinal axis, Z, the inner nozzle with a force sufficient to disrupt a sealing bond formed between the inner nozzle and the stiff seal, until the protrusions face corresponding first channel portions, and then pulling the inner nozzle along the longitudinal axis, Z, wherein the inner nozzle is preferably a two-part inner nozzle.

The inner nozzle preferably comprises rotating grips as described above. The surface of the inner nozzle which is gripped by a tool thus preferably belongs to the rotating grips of the inner nozzle. Retrieving an inner nozzle as described above can be carried out by a robot.

BRIEF DESCRIPTION OF THE FIGURES

For a fuller understanding of the nature of the present invention, reference is made to the following detailed description taken in conjunction with the accompanying drawings in which.

DETAILED DESCRIPTION

Figure 1A:
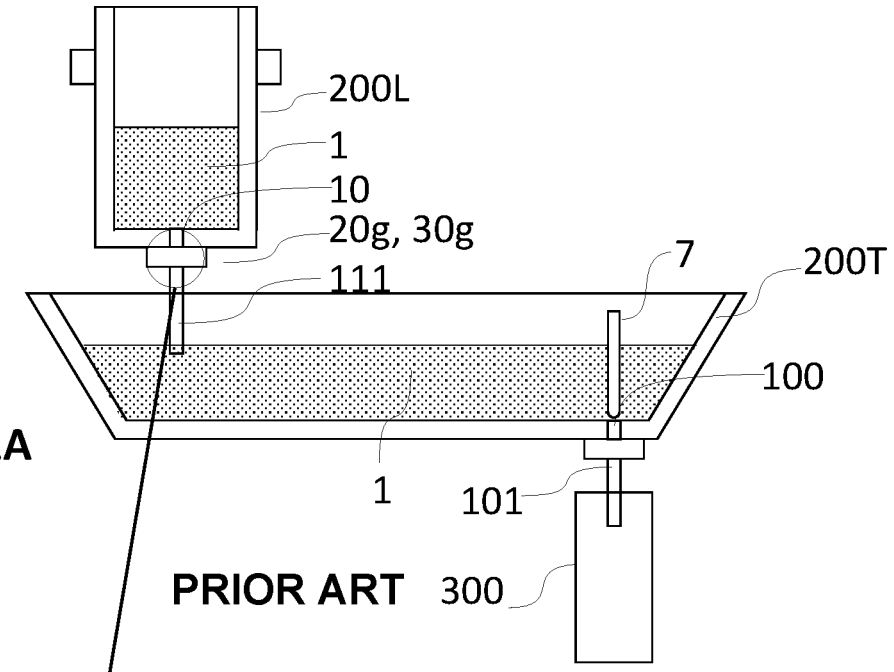
FIG. 1A PRIOR ART
FIG. 1 represents a general view of a casting installation for casting metal.
Figure 1B:
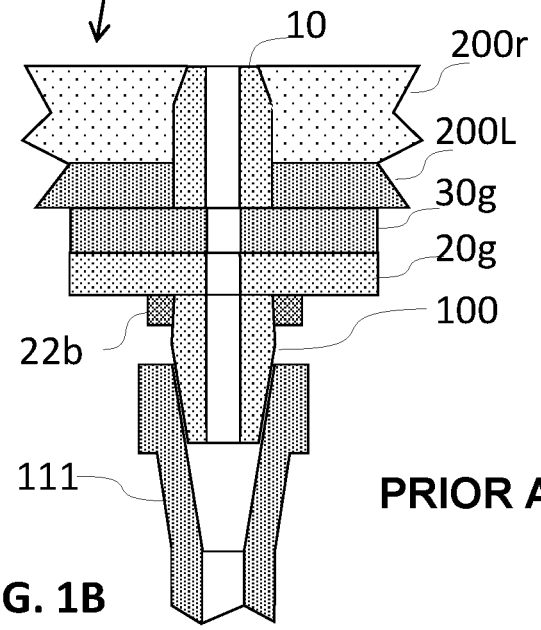
PRIOR ART FIG. 1B

FIG. 1 shows a typical metallurgic installation comprising a ladle (200L) feeding a tundish (200T) with molten metal. The tundish is in fluid communication with a mould (BOO) for forming slabs, billets, beams or ingots. Both ladle and tundish comprise an inner nozzle (10) for guiding the flow of molten metal out of the corresponding metallurgic vessel. The first time it is installed and, subsequently at regular intervals as the refractory components wear off, the inner nozzle must be secured in its operating position inside the outlet of the metallurgic vessel with a stiff seal (2). The stiff seal can be a cement and is formed by applying a sealing material precursor in a yielding state, generally in the shape of a viscous liquid or a paste, and allowed to set to form the stiff seal (2). As long as the sealing material is not sufficiently set, the inner nozzle must be held in its operating position by an operator or by a robot (211). The operator or robot can let the inner nozzle go only after the sealing material is stiff enough to secure the inner nozzle in its operating position. This can take 10 min or more, which is a waste of working time. The term "stiff seat" refers herein to the seal formed by chemical or physical reaction of the sealing material precursor. A person of ordinary skill in the art can recognize when a stiff seal is formed, when it is sufficiently strong to stabilize the inner nozzle within the outlet of the metallurgic vessel.

The self-locking inner nozzle system of the present invention is suitable for locking an inner nozzle (10) in operating position at an outlet of a ladle or of a tundish at least for the time required for a sealing material precursor applied between the inner nozzle and the outlet to set and form a stiff seal suitable for sealing and securing the inner nozzle in its operating position, without requiring any external means to keep the inner nozzle in position during the setting of the sealing material precursor, such as an operator or a robot. The self-locking inner nozzle system of the present invention comprises the following components.

(A) an inner nozzle (10), (B) an upper frame (30*f*) suitable for being rigidly fixed to a bottom surface of a metallurgic vessel, (C) a locking ring (31) rigidly fixed to the frame.

The inner nozzle (10) has a geometry such that it can interact with the locking ring (31) to be locked in position without any external means. In one embodiment, the self-locking of the inner nozzle is only required to be temporary, the time for the sealing material to set and form a stiff seal (2), and needs support the inner nozzle own weight only, as no external forces should be applied onto the inner nozzle during the setting of the sealing material.

(A) INNER NOZZLE (10)

Figure 2:
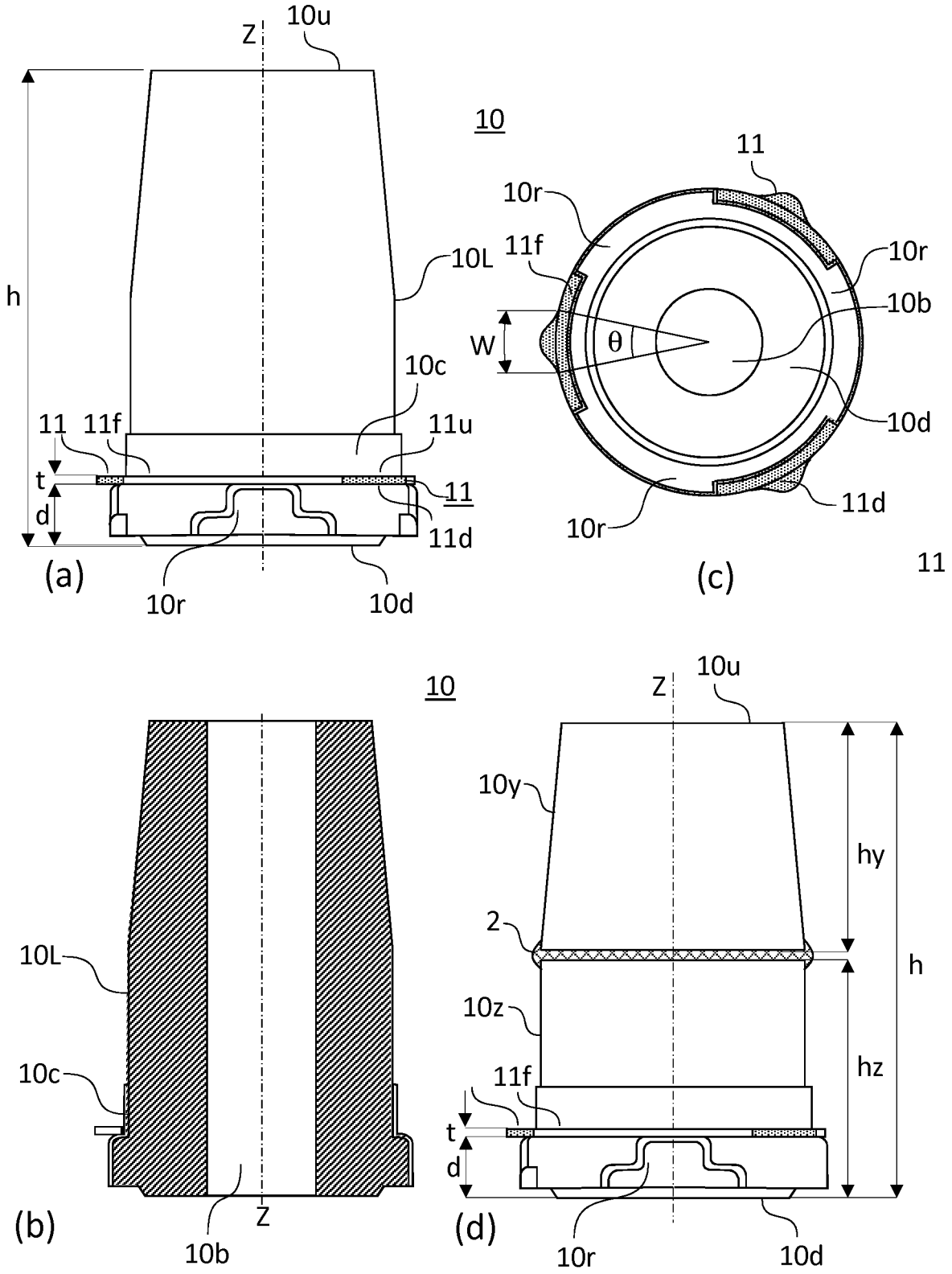
FIG. 2 shows embodiments of the self-locking inner nozzle according to the present invention.

Embodiments of inner nozzles suitable for the system of the present invention are illustrated in FIG. 2. The inner nozzle comprises an upstream surface (10*u*) and a downstream surface (10*d*) joined to one another by a lateral surface (10L) of nozzle height, h. It comprises a bore (10*b*) extending along a longitudinal axis, Z, from the upstream surface to the downstream surface. The inner nozzle of the present invention also comprises N protrusions (11), with N≥2, distributed around a perimeter of the lateral surface. Each protrusion comprises a downstream face (11*d*) facing towards the downstream surface (10*d*), and an upstream face (11*u*) facing towards the upstream surface (10*u*). The downstream face (11*d*) and upstream face (11*u*) are separated from one another by a thickness, t, of the protrusion. The protrusions have an azimuthal width, W, measured normal to the longitudinal axis, Z.

In the present document, the terms "downstream" and "upstream" are defined with respect to the flow of molten metal when the inner nozzle is in its operating position. In FIGS. 2(*a*), (*b*), and (*d*) upstream indicates towards the top and downstream towards the bottom of the illustrated inner nozzles. The "azimuthal width" refers to the length of the arc comprised within an angular portion of angle, θ, (=azimuthal) centred on the longitudinal axis, Z, of the inner nozzle and spanning a protrusion (11) (cf. FIG. 2C).

The inner nozzle can comprise a monolithic bloc of refractory material, referred to as a one-part inner nozzle as illustrated in FIGS. 2A and 2B. Alternatively, it can comprise two parts, an upstream part (10*y*) of height, hy, and a downstream part (10*z*) of height, hz, referred to as a two-part inner nozzle, as illustrated in FIG. 2D. In use, the upstream part (10*y*) and the downstream part (10*z*) of a two-part inner nozzle are joined by a sealing material (2) to form a complete two-part inner nozzle of height, h, with hy+hz≅h. When a two-part inner nozzle needs be changed, generally only the downstream part of the inner nozzle is removed from the outlet and replaced, while the upstream part remains in place. Both alternatives—one-part and two-part nozzles—have their pros and cons well known to a person of ordinary skill in the art, and both can be used in the present invention.

As illustrated in FIG. 2C, it is preferred that the inner nozzle comprises N=3 or 4 protrusions (11), distributed evenly around the perimeter of the lateral surface (10L). A higher number, N, of protrusions would not add any particular advantage upon locking the inner nozzle in its operating position, and could render the removal of a spent inner nozzle more difficult, in case the dismounting requires the deformation or the breaking of said protrusions, as will be explained more in details in continuation. N=3 protrusions is particularly preferred as it ensures a stable positioning of the inner nozzle in the locking ring (31), discussed in continuation. N=2 protrusions is also possible, but the inner nozzle could be less firmly locked in the locking ring than with N=3 protrusions.

The downstream faces (11*d*) of the protrusions (11) distributed around the perimeter of the lateral surface (10L) are advantageously aligned on a common plane normal to the longitudinal axis, Z. The common plane is advantageously closer to the downstream surface (11*d*) than to the upstream surface (11*u*) of the inner nozzle (10). For one-part inner nozzles as illustrated in FIGS. 2A and 2B, the common plane is preferably located at a distance, d, from the downstream surface of the inner nozzle which is not more than 30% of the height, h, of the inner nozzle (d≤0.3 h), preferably not more than 20% of the height, h (d≤0.2 h). The same applies to two-part inner nozzles when assembled, as illustrated in FIG. 2(*d*). With respect to the height, hz, of the downstream part (10*z*) of a two-part inner nozzle (10), the common plane is preferably located at a distance, d, from the downstream surface of the inner nozzle which is not more than 60% of the height, hz, (d≤0.6 hz), or not more than 30% of the height, hz (d≤0.3 hz). The common plane in both one-part and two-part inner nozzles can be located at a distance, d, from the downstream surface (10*d*) of not more than 250 mm (d≤250 mm), or not more than 150 mm, or not more than 100 mm.

In an advantageous embodiment, the protrusions (11) are made of a material which is brittle or ductile, and the protrusions have dimensions such that the protrusions are strong enough to support the inner nozzle own weight and, at the same time, can be deformed by bending or broken upon removing the inner nozzle from the operating position, preferably by human force. For example, the protrusions can be broken or bent by application of a force of not more than 400 N on top of the inner nozzle own weight, advantageously of not more than 200 N or than 150 N or even than 100 N on top of the inner nozzle own weight. The resistance to bending or rupture of the protrusions is advantageously higher than the inner nozzle own weight, or at least 50 N higher than the inner nozzle own weight. If a robot is used, higher forces can be applied to bend or break the protrusions. The protrusions do not secure the inner nozzle, they merely lock it in position for the time required for the sealing material precursor to set into a stiff seal (2) which seals and secures the inner nozzle in its operating position. It follows that the protrusions need not be dimensioned so as to resist the stresses applied to the inner nozzle during use by the flowing metal, but simply to resist the own weight of the inner nozzle for a limited duration. As explained more in detail in Section (E) below, when an inner nozzle is spent and needs be changed, one common way to remove the spent nozzle from the outlet is to pull it out along the longitudinal axis, Z, by sheer human force using specific tools, for disrupting the layer of stiff seal (2). With protrusions (11) made of a ductile or brittle material and dimensioned accordingly, they can at the same time, self-lock the inner nozzle in its operating position as the sealing material precursor is setting, and allow the pulling out of the inner nozzle when spent without having to unlock it first, by the same technique commonly used, the pulling force applied for pulling the spent inner nozzle out of the outlet being sufficient for bending or breaking the protrusions.

As well known in the art, the inner nozzle preferably comprises a metal can cladding at least a portion of the lateral surface (10L) of the inner nozzle. The metal can preferably lines at least a portion of the lateral surface which is adjacent to the downstream surface (10*u*) of the inner nozzle.

In an advantageous embodiment, the protrusions (11) are made of metal. They can be an integral part of the metal can, or can be coupled to the metal can by welding, soldering, or by any coupling method known in the art. In another advantageous embodiment illustrated in FIG. 2, the protrusions (11) belong to a flange (11*f*) surrounding a whole perimeter of the lateral surface, normal to the longitudinal axis, Z. The flange is preferably made of metal and can be coupled to the metal can by welding, soldering, or by any coupling method known in the art. The flange (11*f*) has the advantage of retaining any metal percolating through the stiff seal (2) in case of leaks therein, and thus keeping clean from any metal the portion of the inner nozzle located downstream from the flange, including the downstream surface (10*d*).

The lateral surface of the inner nozzle preferably comprises rotating grips (10*r*), including lugs or recesses positioned adjacent to the downstream surface of the inner nozzle, and allowing the insertion of a tool for rotating the inner nozzle about the longitudinal axis, Z, and pulling the inner nozzle out of the locking ring along the longitudinal axis, Z, when the inner nozzle is inserted in the locking ring. Such rotating grips are very useful for carrying out operations including both mounting and removing an inner nozzle into and out of an outlet of a metallurgic vessel. Such rotating grips also simplify the use of a robot for carrying out all these operations autonomously. This is advantageous over prior art inner nozzles in that the rotating grips are part of the lateral surface of the inner nozzle which is not, or little worn during use. This way, the rotating grips maintain their full integrity and strength upon removing a spent inner nozzle. By contrast, conventional inner nozzles are removed after use by inserting a tool through the bore of the inner nozzle, which is a portion of the inner nozzle most affected by wear during use. In some cases, the wear can be so severe that the insertion and pulling of the tool may disrupt the integrity of the spent inner nozzle, rendering removal more cumbersome.

The rotating grips (10*r*) are preferably made of metal. They also preferably belong to a metal can cladding at least a portion of the lateral surface (10L) of the inner nozzle which is adjacent to the downstream surface (10*d*). The rotating grips (10*r*) illustrated in FIG. 2 are T-shaped to allow a firm grip for both rotating the inner nozzle about the longitudinal axis, Z, and pulling the inner nozzle along Z. Other geometries are of course possible and do not limit the present invention. A robot can easily identify the positions of the rotating grips, can grip them easily, and handle the inner nozzle as required, including rotating, pushing and pulling the inner nozzle during operations for both mounting a new inner nozzle and removing a spent inner nozzle.

(B) UPPER FRAME (30F)

As shown in FIGS. 1, 4-6, a metallurgic vessel (200), such as a ladle (200L) or a tundish (200T) comprises an outer shell made of metal and an inner liner (200*r*) made of refractory material, for insulating the outer shell from the high temperature of the molten metal (1) contained in the metallurgic vessel. At the bottom floor of the vessel, the outer shell comprises an opening, continued by a channel extending along the longitudinal axis, Z, through the inner liner and, together, forming an outlet of the metallurgic vessel.

An upper frame (30*f*) is rigidly fixed to an outer surface of the bottom floor of the outer shell. The upper frame is made of metal and is rigidly fixed to the bottom floor of the outer shell by fixing means (3) well known in the art, generally including screws and bolts. The upper frame (30*f*) forms a coupling interface between the metallurgic vessel and the refractory components defining a flow channel for the flow of molten metal out of the metallurgic vessel. Said refractory components include one or more of an inner nozzle (10), a collector nozzle (100), gate plates (20*g*, 25*g*, 30*g*), a pouring nozzle (101), a ladle shroud (111), etc.

The inner nozzle (10) must be secured in the outlet of the metallurgic vessel, with the upstream surface (10*u*) facing towards the interior of the metallurgic vessel and being inserted in the outlet, within the channel in the inner lining. The gap between the channel and the lateral surface (10L) of the inner nozzle is sealed with a stiff seal (2) which also secures the inner nozzle in its operating position. The downstream surface (10*d*) faces away from the vessel, and is located outside of the metallurgic vessel. According to the present invention, the downstream surface of the inner nozzle is located at the level of the upper frame, with respect to the longitudinal axis, Z, where it interacts with the locking ring (31) described more in detail in Section (C)) below.

Figure 5:
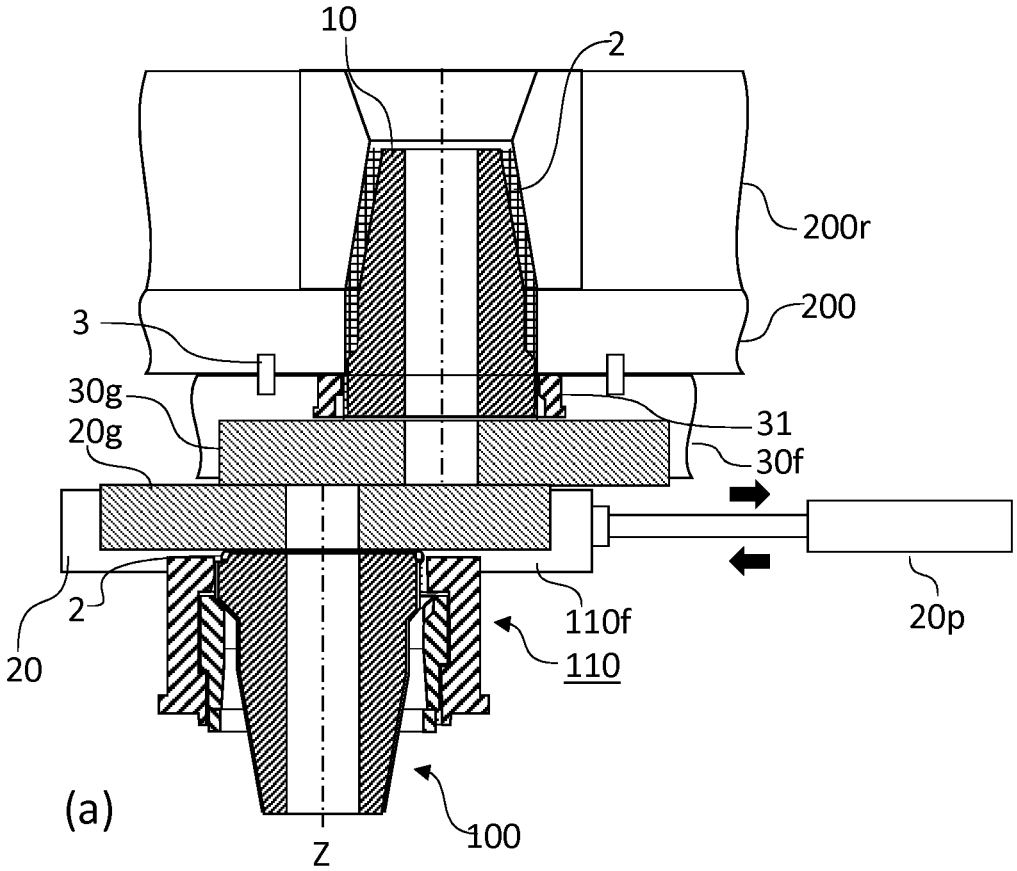
FIG. 5 shows a two-plate sliding gate comprising a self-locking inner nozzle according to the present invention (a) in closed position, and (b) in open position
Figure 5:
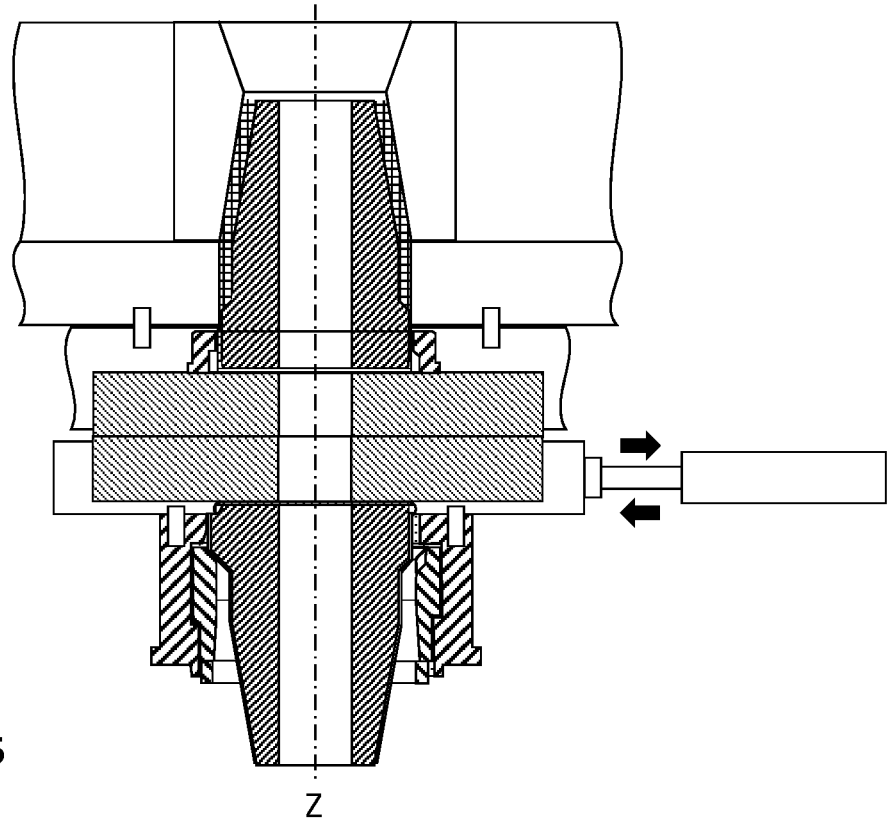
Figure 6:
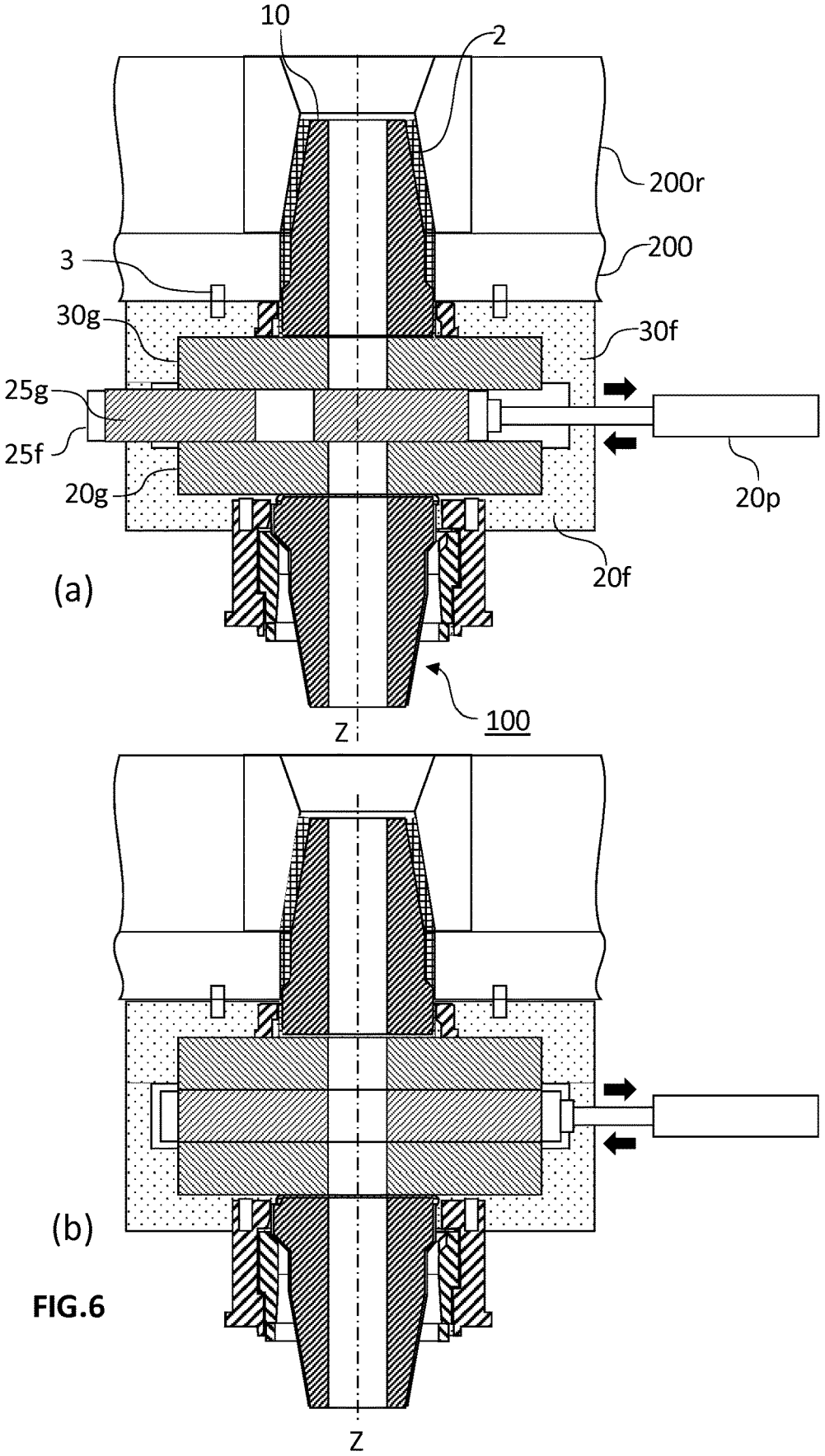
FIG. 6 shows a three-plate sliding gate comprising a self-locking inner nozzle according to the present invention (a) in closed position, and (b) in open position.

The flow rate of molten metal out of a metallurgic vessel can be controlled by a sliding gate or a rotating gate. One example of two-plate sliding gate is illustrated in FIG. 5 and a three-plate sliding gate is shown in FIG. 6. The upper frame (30*f*) comprises a coupling unit for receiving and rigidly fixing an upper plate (30*g*) of a two-plate or three-plate sliding gate. The upper plate is provided with a bore positioned in registry with the bore of the inner nozzle. The downstream surface (10*d*) of the inner nozzle (10) is sealed to an upper surface of the upper plate (30*g*) with a layer of sealing material (2). On the one hand, the stiff seal (2) filling the gap between the outlet and the inner nozzle and, on the other hand, the upstream surface of the rigidly fixed downstream nozzle on which rests the rigidly fixed upper plate (30*g*), both ensure that the inner nozzle is safely secured in the outlet during the flow of molten metal through the bore (10*b*).

In a two-plate gate as illustrated in FIG. 5, a bottom plate (20*g*) provided with a bore is received and rigidly fixed to a mobile carriage (20), which can move along a direction normal to the longitudinal direction, Z, actuated by a hydraulic piston (20*p*) such that an upstream surface of the bottom plate (20*g*) slides over a downstream surface of the upper plate (30*g*), such as to bring the bore of the bottom plate (20*g*) in and out of registry with the bore of the upper plate (30*g*). A collector nozzle (100) is rigidly coupled to a downstream surface of the bottom plate (30*g*), by fixing the collector nozzle to the mobile carriage (20).

In a three-plate gate as illustrated in FIG. 6, a bottom plate (20*g*) provided with a bore is received and rigidly fixed to the upper frame (30*f*) with an upstream surface of the bottom plate parallel to and separated from a downstream surface of the upper plate, such that the two bores of the upper and bottom plates are in registry. A collector nozzle (100) is rigidly coupled to a downstream surface of the bottom plate (30*g*), by fixing the collector nozzle to the upper frame (30*f*).

A middle plate (25*g*) provided with a bore is received and rigidly fixed to a mobile carriage (25*f*), which can move like a drawer between the fixed upper and bottom plates (20*g*, 30*g*) along a direction normal to the longitudinal direction, Z, actuated by a hydraulic or pneumatic cylinder (20*p*) or electric drive such that an upstream surface of the middle plate (25*g*) slides over a downstream surface of the upper plate (30*g*), and a downstream surface of the middle plate (25*g*) slides over an upstream surface of the bottom plate (20*g*), such as to bring the bore of the middle plate (20*g*) in and out of registry with the bores of the upper and bottom plates (20*g*, 30*g*).

The upper frame (30*f*) can be rigidly fixed to a bottom surface of any metallurgic vessel, such as a ladle, a furnace, or a tundish.

(C) LOCKING RING (31)

Figure 3:
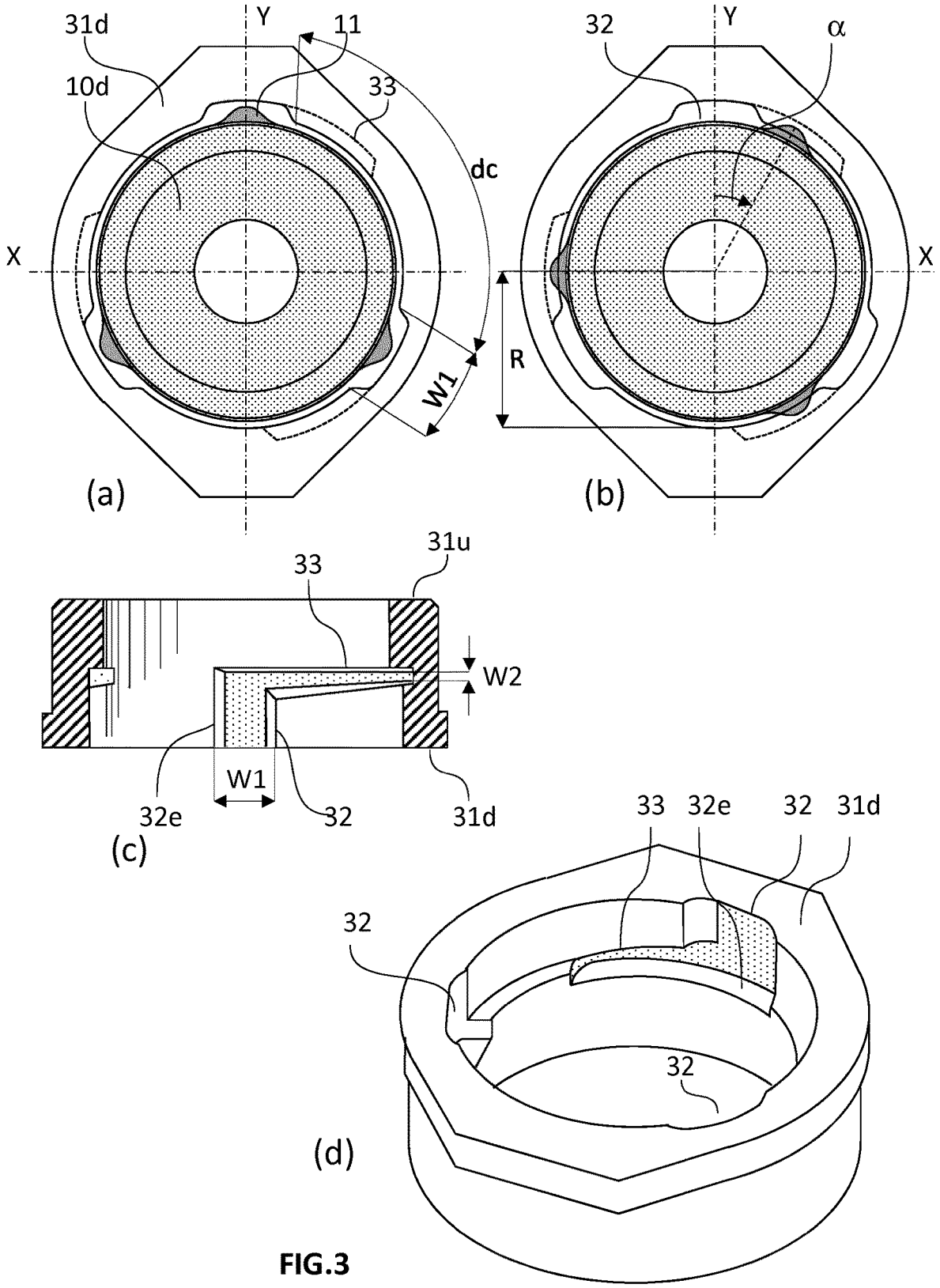
FIG. 3 shows a locking ring mating the self-locking inner nozzle of the present invention.

The gist of the present invention is the locking ring (31), which is rigidly fixed to the upper frame (30*f*) and, in combination with the protrusions (11) serves to lock the inner nozzle in its operating position at least for the time required for the sealing material precursor to set into a stiff seal (2). An example of locking ring (31) is illustrated in FIG. 3. The locking ring extends along the longitudinal axis, Z, from an upstream edge (31*u*) to a downstream edge (31*d*), and defines an opening defined by an inner surface joining the upstream and downstream edges.

The inner surface of the locking ring is provided with a number N of L-shaped channels. Each of the L-shaped channels has:

(a) a first channel portion (32) extending parallel to the longitudinal axis, Z, from the downstream edge to a first channel end (32*e*) of the first channel portion, and having a width, W1, larger than the width, W, of the protrusions, allowing the translation along the longitudinal axis, Z, of the inner nozzle through the opening of the locking ring with the upstream surface engaged first on the downstream edge side of the locking ring, with the protrusions engaged in corresponding first channel portions (32) until the protrusions abut against the corresponding first channel ends (32*e*), where the inner nozzle is prevented from translating further along the longitudinal axis, Z, and (b) a second channel portion (33) extending transverse to the longitudinal axis, Z, from the first channel end and having a width, W2, larger than the thickness, t, of the protrusions (11), allowing the engagement of the protrusions (11) into the corresponding second channel portions (33) by the rotation of the inner nozzle about the longitudinal axis, Z, into a locking position, where the inner nozzle is prevented from being pulled out of the locking ring by the protrusions being engaged in the second channel portion.

It is advantageous that the second channel portion comprises a lateral edge on the side of the downstream edge of the locking ring which is non-parallel to the downstream surface of the inner nozzle and extending at an angle forming a thread, such that the rotation of the inner nozzle towards the locking position translates the inner nozzle deeper through the locking ring. The locking ring acts like a bayonet or a thread interacting with the protrusions (11) of the inner nozzle as the inner nozzle is being rotated about the longitudinal axis, Z. The locking angle, a, of rotation required to lock the inner nozzle in its operating position needs not be very large. The maximum magnitude of the rotating angle depends on the distance, dc, separating two adjacent first channel portions (32) distributed around a perimeter of the inner surface of radius, R. If the N first channel portions have same width, W1, and are distributed uniformly around the perimeter, the locking angle, a, is preferably smaller than dc/R [rad]. The distance covered by a protrusion upon rotation of the inner nozzle by a locking angle $\alpha$ is $\alpha R$, which is preferably smaller than dc, hence, $\alpha < dc/R$. For example, a rotation of the inner nozzle of locking angle, $\alpha$, of not more than 45°, or not more than 35° with respect to the locking ring suffices to insert the protrusions against an end of the second channel portions (33) and to safely self-lock the inner nozzle in its operating position. For safety reasons, the locking angle, $\alpha$, is preferably at least 10°.

In an advantageous embodiment, the second channel portion (33) is tapered, getting thinner away from the first channel portion (32). The protrusions (11) preferably have a thickness, t, that tapers along the azimuthal width, W, of the protrusions, such that when the inner nozzle has been rotated to its self-locking position, the tapers of the protrusions mate the tapers of the corresponding second channel portions, such that the upstream and downstream faces of the protrusions contact the two lateral edges defining the second channel portion. With this design, not only the inner nozzle is prevented from moving out of the locking ring, but it is also prevented from moving further through the locking ring along the longitudinal axis, Z.

(D) METHOD FOR SECURING AN INNER NOZZLE IN AN OUTLET OF A METALLURGY VESSEL

With a self-locking inner nozzle system according to the present invention, securing an inner nozzle (10) in operating position in an outlet of a metallurgic vessel is greatly simplified compared with state of the art systems. A metallurgic vessel (200) as described supra is coupled to an upper frame (30*f*) rigidly fixed to a bottom surface of the metallurgic vessel, at the level of an outlet. A locking ring (31) as described supra is rigidly fixed to the upper frame, with the opening of the locking ring in registry with the outlet of the metallurgic vessel, and the downstream edge (31*d*) facing away from the metallurgic vessel. For sealing and securing an inner nozzle to the outlet, a sealing material precursor is applied in a yielding form (e.g., liquid or pasty) into the outlet of the metallurgic vessel and/or onto the lateral surface of the inner nozzle.

Figure 4:
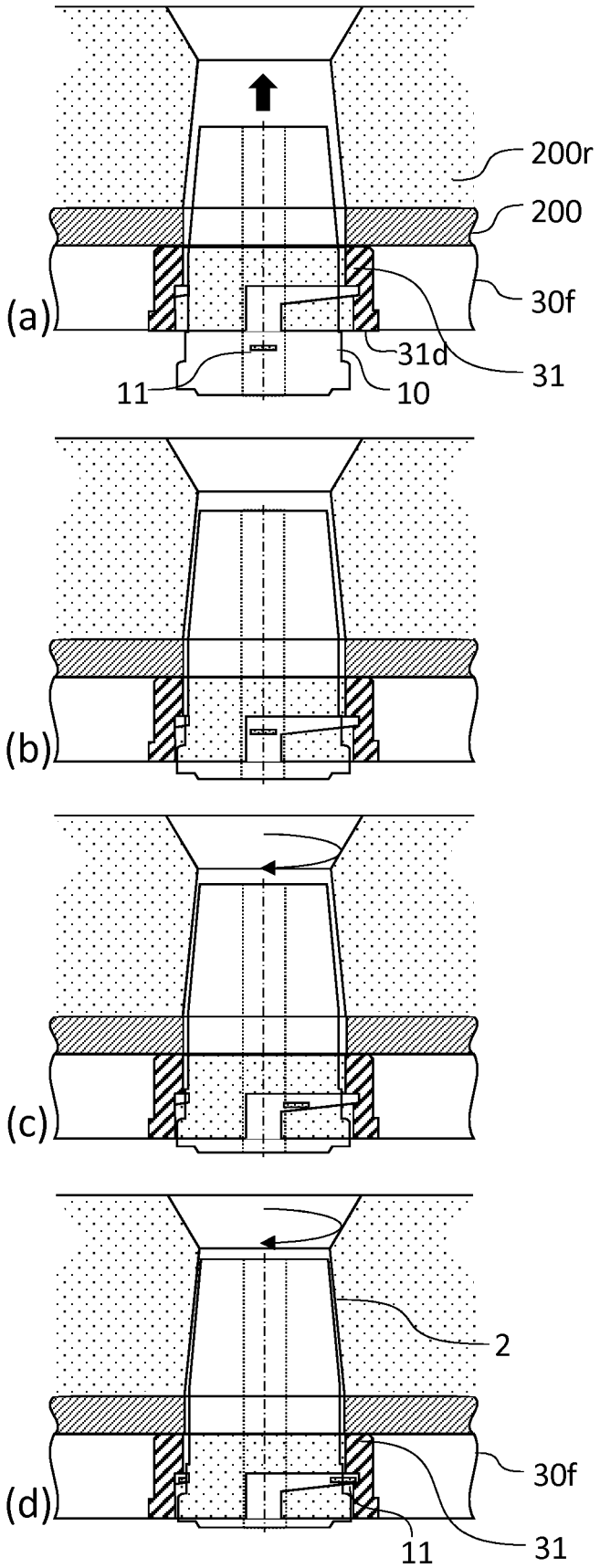
FIG. 4 illustrates the principle of locking an inner nozzle to a frame provided with a locking ring fixed to a bottom of a metallurgic vessel according to the present invention.

As illustrated in FIG. 4, the inner nozzle (10) can be engaged with the upstream surface first through the locking ring opening from the downstream edge (31*d*) (cf. FIG. 4A). The inner nozzle can be driven along the longitudinal axis, Z, through the locking ring with the N protrusions engaged in corresponding first channel portions (32), all the way until the protrusions abut against the first channel ends (32*e*). At this stage, it is not possible to translate the inner nozzle any further through the opening of the locking ring along the longitudinal axis, Z (cf. FIG. 4(*b*)). The sealing material precursor fills the gap between the outlet of the metallurgic vessel and the lateral surface (10L) of the inner nozzle. At this stage, the sealing material precursor is still in a yielding state, and can be deformed easily without damaging it.

The inner nozzle can be rotated about the longitudinal axis, Z, thus engaging the protrusions into the second channel portions (33) until the inner nozzle is self-locked into its operating position (cf. FIGS. 4C and 4D). Since the protrusions (11) do not face the corresponding first channel portions (32) anymore, and are engaged relatively deep into the transversally extending second channel portions (33), the inner nozzle cannot move along the longitudinal axis, Z, and is self-locked in its operating position. By "self-locked" it is meant herein that the inner nozzle is able to retain its position without the assistance of any external means, such as the hands of an operator, the grip of a robot, or the like.

Since the inner nozzle is self-locked in its operating position, the sealing material precursor can be allowed to set and transform into a stiff seal (2) to seal and secure in its operating position the thus self-locked inner nozzle, without holding it in position by any external means. This represents a major breakthrough with respect to the state-of-the-art methods, which invariably required an operator or a robot to firmly hold the inner nozzle for the time required for the sealing material precursor to set.

The inner nozzle is thus locked in its operating position by the interaction of the protrusions (11) with the L-shaped channels of the locking ring (31). It is then secured in its operating position by the stiff seal (2) formed in the gap between the outlet and the inner nozzle. The inner nozzle maintains its position when pressing a refractory component including a gate upper plate (30*g*) or a downstream nozzle (100, 101), against the downstream surface (10*d*) of the inner nozzle to form a sealed contact with a sealing material. At this stage, the inner nozzle is safely secured in its operating position by, on the one hand, the stiff seal (2) between the outlet and the inner nozzle and, on the other hand, by the inner nozzle resting on the upstream surface of an upper gate plate or of a downstream nozzle.

The method for securing the inner nozzle in the outlet of the vessel has also the additional advantage of controlling the position along the longitudinal axis, Z, of the inner nozzle within the casting channel. Indeed, the protrusions abut against the first channel ends (32*e*) preventing, this way, the inner nozzle from translating any further into the casting channel. The first channel ends (32*e*) act as a positive stop setting the inner nozzle in a defined position allowing this way the control of the thickness of the joint between the inner nozzle bottom surface (10*d*) and the upper surface of the upper refractory plate (30*g*).

The first goal of the present invention was to self-lock an inner nozzle in its operating position at least for the time required for the sealing material to set into a hard seal (2). An advantageous embodiment of the present invention includes dimensioning the protrusions (11) such that they can easily be broken or deformed by application of a moderate force, such as a human force. This embodiment must use a sealing material precursor setting into a stiff enough seal to secure the inner nozzle in its operating position. If, on the contrary, the protrusions are dimensioned such as to be strong enough to resist substantial stresses, the protrusions can serve to both self-lock the inner nozzle and secure it in its operating position. In these conditions, a sealing material can be chosen that does not necessarily set to form a seal stiff enough to secure the inner nozzle in its operating position. For example, an intumescent powder or foam can be used, which sole function would be to seal the gap between the outlet and the inner nozzle, and not to secure the inner nozzle in its operating position, this function being carried out by strong protrusions (11) engaged in the second channel portion (33) of the lock ring (31). Intumescent materials used as sealing elements in metallurgic installations are described, e.g., in EP2790856.

All the handling manipulations of the inner nozzle required for securing it to the outlet of a metallurgic vessel can easily be carried out by a robot. These operations can be completed rapidly, and the robot is then available for further tasks, because it is not required to hold the inner nozzle in its operating position while the sealing material precursor is setting. In all cases, but in particular for use with a robot, an inner nozzle comprising rotating grips (10*r*) as discussed supra is particularly advantageous.

(E) METHOD FOR RETRIEVING AN INNER NOZZLE FROM AN OUTLET OF A METALLURGIC VESSEL

An inner nozzle secured in a self-locking inner nozzle system of the present invention is locked by the protrusions (11) engaged in the corresponding second channel portions (33) and is secured in its operating position by, on the one hand, the stiff seal (2) filling the gap between the outlet and the inner nozzle and, on the other hand, by resting on the upstream surface of an upper plate (30*g*) of a gate system (cf. FIGS. 5A, 5B, 6A, and 6B), to which it is sealed by a sealing material (2). When an inner nozzle is worn and needs be changed, it can be removed from the outlet by gripping a surface of the inner nozzle with a tool and apply any of the following methods depending on the type of inner nozzle (10) and sealing material precursor (2) used.

If the inner nozzle comprises protrusions (11) made of a material which is brittle or ductile, and have dimensions such that the protrusions can be deformed or broken by application of a moderate force, such as human force, the inner nozzle can be pulled using the tool along the longitudinal axis, Z, with a force sufficient to, on the one hand, disrupt a sealing bond formed between the inner nozzle and the stiff seal (2) and, on the other hand, to break or bend the protrusions (11) to allow the passage of the inner nozzle through the opening of the locking ring. This technique is actually an adaption of a most commonly used technique for retrieving a spent inner nozzle in state-of-the-art systems, consisting of introducing a hook shaped tool through the bore of an inner nozzle, resting the hooked portion onto the upstream surface of the inner nozzle and pulling out. With a system according to the present invention, this is possible only if the protrusions (11) can break or be deformed easily, thus allowing the inner nozzle to be pulled out of the opening of the locking ring. The inner nozzle is advantageously provided with rotating grips (10*r*) which allow a better grip of the inner nozzle than a tool inserted in the bore.

Alternatively, the inner nozzle can be rotated about the longitudinal axis, Z, with a force sufficient to disrupt a sealing bond formed between the inner nozzle and the stiff seal (2), driving the protrusions (11) along the corresponding second channel portions (33) until they face corresponding first channel portions (32). At this point, the inner nozzle can be pulled out along the longitudinal axis, Z. This step is quite easy because, on the one hand, the stiff seal (2) has already been disrupted by the rotation of the inner nozzle and, on the other hand, the protrusions (11) of the inner nozzle face the first channel portions (32) of the locking ring, and can slide along the first channel portions without any further resistance. This technique is required if the protrusions are too strong to bend or break easily.

With both removal techniques and, particularly for the latter including the rotation of the inner nozzle, less force is required to retrieve the inner nozzle if it is a two-part inner nozzle, since the joint between the upstream part (10*y*) and the downstream part (10*z*) can readily break, considerably reducing the area of stiff seal (2) to be broken by rotation of the inner nozzle.

Again, like the mounting, all the operations for removing an inner nozzle from a system according to the present invention can be carried out by a robot. The presence of rotating grips (10*r*) is here again preferred.

(F) CONCLUSION

In its simplest embodiments, a self-locking inner nozzle system according to the present invention facilitates the securing of an inner nozzle in the outlet of a metallurgic vessel, by self-locking the inner nozzle in its operating positions for at least a time required for a sealing material precursor applied in the gap between the outlet and the inner nozzle to set into a stiff seal (2) without requiring any external means for holding it in place. This alone represents a major breakthrough as it increases the availability of a human operator or of a robot, which are not required anymore for holding the inner nozzle in position until the seal (2) is set, as was the case to date.

The inner nozzle system of the present invention also allows for a precise control of the position of the inner nozzle along the longitudinal axis, Z, within the casting channel and of the thickness of the joint between the inner nozzle bottom surface and the upper surface of the upper refractory plate.

Providing the inner nozzle with rotating grips (10*r*) substantially facilitate the handling of an inner nozzle to move it in and out of the outlet, by pulling, pushing, and rotating the inner nozzle. The rotating grips are also advantageous when using a robot for mounting and/or removing an inner nozzle into and/or out of the outlet.

The protrusions (11) are preferably made of metal and can be coupled directly to a metal can (10*c*). Alternatively, they can be part of a flange (11*f*) encircling the lateral surface of the inner nozzle. The flange is advantageous in that it can retain any metal flowing through leaks in the seal (2).

The protrusions can be brittle or ductile such that, upon removal of the inner nozzle by pulling it out along the longitudinal axis, the protrusions can break or bend to allow passage of the inner nozzle through the opening of the locking ring.

In an alternative embodiment, the protrusions (11) are stiff enough to both lock and secure the inner nozzle in its operating position. This has the advantage that sealing materials having good sealing properties but poor mechanical properties can be used to form a seal between the outlet and the inner nozzle. Removal of the inner nozzle requires rotation of the inner nozzle followed by pulling the inner nozzle out along the longitudinal axis, Z, with the protrusions sliding along the corresponding first channel portions (32) of the locking ring (31).

Various features and characteristics of the invention are described in this specification and illustrated in the drawings to provide an overall understanding of the invention. It is understood that the various features and characteristics described in this specification and illustrated in the drawings can be combined in any operable manner regardless of whether such features and characteristics are expressly described or illustrated in combination in this specification. The Inventor and the Applicant expressly intend such combinations of features and characteristics to be included within the scope of this specification, and further intend the claiming of such combinations of features and characteristics to not add new matter to the application. As such, the claims can be amended to recite, in any combination, any features and characteristics expressly or inherently described in, or otherwise expressly or inherently supported by, this specification. Furthermore, the Applicant reserves the right to amend the claims to affirmatively disclaim features and characteristics that may be present in the prior art, even if those features and characteristics are not expressly described in this specification. Therefore, any such amendments will not add new matter to the specification or claims, and will comply with the written description requirement under 35 U.S.C. § 112(a). The invention described in this specification can comprise, consist of, or consist essentially of the various features and characteristics described in this specification.

| Ref.# | Feature |
|---|---|
| 1 | Molten metal |
| 2 | Sealing material |
| 3 | Rigid fixation |
| 10 | Inner nozzle |
| 10b | Inner nozzle bore |
| 10c | Metal can |
| 10d | Inner nozzle downstream surface |
| 10L | Inner nozzle lateral surface |
| 10r | Rotating grip |
| 10u | Inner nozzle upstream surface |
| 10y | Upstream part of a two-part inner nozzle |
| 10z | Downstream part of a two-part inner nozzle |
| 11 | Protrusion |
| 11d | Protrusion lower surface |
| 11f | Flange |
| 11u | Protrusion upper surface |
| 10y | Upstream part of two-part inner nozzle |
| 10z | Downstream part of two-part inner nozzle |
| 20 | Carriage for holding a bottom plate 20g |
| 20g | Lower gate plate |
| 20p | Hydraulic piston |
| 25f | Carriage for holding a middle plate 25g |
| 25g | Middle plate in a three-plate sliding gate |
| 30f | Upper frame |
| 30g | Upper gate plate |
| 31 | Locking ring |
| 31d | Downstream edge of the locking ring |
| 31u | Upstream edge of the locking ring |
| 32 | First channel portion |
| 32e | First channel end |
| 33 | Second channel portion |
| 100 | Collector nozzle |
| 101 | Pouring nozzle |
| 111 | Ladle shroud |
| 200 | Metallurgic vessel |
| 200L | Ladle |
| 200r | Refractory lining of the Metallurgic vessel |
| 200T | Tundish |

-continued

| Ref.# | Feature |
|---|---|
| 211 | Robot |
| D | Distance between downstream faces of protrusions and downstream surface 10d |
| Dc | Distance between two adjacent first channel portions |
| R | Radius of the locking ring inner surface |
| W | Protrusion width (maximum) |
| W1 | Width of the first channel portion |
| W2 | Width of the second channel portion |
| X | First transverse axis |
| Y | Second transverse axis |
| Z | Longitudinal axis |
| α | Locking angle of rotation of the inner nozzle |
| θ | Azimuthal angle of a protrusion 11 |

What is claimed is:

1. Self-locking inner nozzle system comprising:

(A) an inner nozzle comprising:

(a) a nozzle upstream surface and a nozzle downstream surface joined to one another by a lateral surface of nozzle height, h, and comprising a bore extending along a longitudinal axis (Z) from the nozzle upstream surface to the nozzle downstream surface, (b) N protrusions, with N≥2, distributed around a perimeter of the lateral surface, each protrusion comprising a downstream face and an upstream face separated from one another by a thickness, t, of the protrusion, the protrusions having an azimuthal width (W) measured normal to the longitudinal axis (Z), (B) an upper frame having an upper frame upstream surface, wherein the upper frame upstream surface is configured to be rigidly fixed to a bottom surface of a metallurgic vessel, (C) a locking ring, rigidly fixed to the upper frame and extending along the longitudinal axis (Z) from an upstream edge to a downstream edge, and defining an opening defined by an inner surface joining the upstream and downstream edges, wherein the inner surface of the locking ring is provided with a number N of L-shaped channels, each L-shaped channel having:

(a) a first channel portion extending along the longitudinal axis (Z) from the downstream edge to a first channel end of the first channel portion, and having a width (W1) larger than the width (W) of the protrusions, allowing the translation along the longitudinal axis (Z) of the inner nozzle through the opening of the locking ring with the upstream surface engaged first on the downstream edge side of the locking ring, with the protrusions engaged in corresponding first channel portions until the protrusions abut against the corresponding first channel ends, where the inner nozzle is prevented from translating further along the longitudinal axis (Z) and (b) a second channel portion extending transverse to the longitudinal axis (Z) from the first channel end and having a width, W2, larger than the thickness, t, of the protrusions, allowing engagement of the protrusions into the corresponding second channel portions by the rotation of the inner nozzle about the longitudinal axis (Z) into a locking position, where the inner nozzle is prevented from being pulled out of the locking ring by the protrusions being engaged in the second channel portion.

2. Self-locking inner nozzle system according to claim 1, wherein N=3 or 4, and wherein the N protrusions are distributed evenly around a perimeter of the lateral surface.

3. Self-locking inner nozzle system according to claim 1, wherein the second channel portion comprises a lateral edge on the side of the downstream edge of the locking ring which is at an angle forming a thread, such that the rotation of the inner nozzle towards the locking position translates the inner nozzle deeper through the locking ring.

4. Self-locking inner nozzle system according to claim 1, wherein the lateral surface of the inner nozzle comprises rotating grips, including lugs or recesses positioned adjacent to the downstream surface of the inner nozzle, and allowing the insertion of a tool for rotating the inner nozzle about the longitudinal axis (Z) and pulling the inner nozzle out of the locking ring along the longitudinal axis (Z) when the inner nozzle is inserted in the locking ring.

5. Self-locking inner nozzle system according to claim 1, wherein the protrusions have a composition and configuration such that the protrusions can be deformed or broken by application of a force of not more than 400 N, upon removing the inner nozzle from the operating position.

6. Self-locking inner nozzle system according to claim 1, wherein the protrusions are made of metal and have a configuration selected from the group consisting of:

coupled to a metal can cladding at least a portion of the lateral surface of the inner nozzle, part of a flange surrounding a whole perimeter of the lateral surface, normal to the longitudinal axis (Z), and a combination of each of these configurations.

7. Self-locking inner nozzle system according to claim 4, wherein the rotating grips are made of metal and belong to a metal can cladding at least a portion of the lateral surface of the inner nozzle.

8. Self-locking inner nozzle system according to claim 1, wherein the protrusions are located at a distance, d, to the downstream surface measured along the longitudinal axis (Z) of not more than 30% of the nozzle height, h.

9. Self-locking inner nozzle system according to claim 1, which is mounted at a bottom surface of a metallurgic vessel.

10. Self-locking inner nozzle system according to claim 9, which is part of a gate system mounted at the bottom of the metallurgic vessel.

11. Method for securing an inner nozzle in operating position to an outlet of a metallurgic vessel, said method comprising the following steps:

(a) providing a self-locking inner nozzle system according to claim 1, (b) applying a sealing material precursor into a location selected from the group consisting of the outlet of the metallurgic vessel, the lateral surface of the inner nozzle, and each of the outlet of the metallurgic vessel and the lateral surface of the inner nozzle, (c) engaging the inner nozzle with the upstream surface first through the locking ring opening from the downstream edge, and driving the inner nozzle along the longitudinal axis (Z) through the locking ring with the N protrusions engaged in corresponding first channel portions, all the way until the protrusions abut against the first channel ends, (d) rotating the inner nozzle about the longitudinal axis (Z) thus engaging the protrusions into the second channel portions until the inner nozzle is self-locked into its operating position and cannot move along the longitudinal axis (Z)

(e) allowing the sealing material precursor to transform into a stiff seal to seal and secure in its operating position the thus self-locked inner nozzle, without holding it in position by any external means.

12. Method according to claim 11, wherein at least one of steps (c) and (d) is carried out by a robot.

13. Method for retrieving from an outlet of a metallurgic vessel an inner nozzle as defined in claim 11, the inner nozzle previously secured in its operating position by a method according to claim 11, said method comprising the step of gripping a surface of the inner nozzle with a tool and a step selected from the group consisting of:

(a) pulling the inner nozzle along the longitudinal axis (Z) with a force sufficient to, on the one hand, disrupt a sealing bond formed between the inner nozzle and the stiff seal and, on the other hand, to break or deform the protrusions to allow the passage of the inner nozzle through the opening of the locking ring, rotating about the longitudinal axis (Z) the inner nozzle with a force sufficient to disrupt a sealing bond formed between the inner nozzle and the stiff seal, until the protrusions face corresponding first channel portions, and then pulling the inner nozzle along the longitudinal axis (Z).

14. Method according to claim 13, wherein the lateral surface of the inner nozzle comprises rotating grips, including lugs or recesses positioned adjacent to the downstream surface of the inner nozzle, and allowing the insertion of a tool for rotating the inner nozzle about the longitudinal axis (Z) and pulling the inner nozzle out of the locking ring along the longitudinal axis (Z) when the inner nozzle is inserted in the locking ring, and wherein the surface of the inner nozzle which is gripped by a tool belongs to the rotating grips of the inner nozzle.

15. Method according to claim 13, which is carried out by a robot.

* * * * *